US010494784B2

(12) United States Patent
Mannering et al.

(10) Patent No.: US 10,494,784 B2
(45) Date of Patent: Dec. 3, 2019

(54) ANCHOR DRIVING DEVICE

(71) Applicant: CASHMAN DREDGING AND MARINE CONTRACTING, CO., LLC, Quincy, MA (US)

(72) Inventors: Tim Mannering, Marshfield, MA (US); Corey Welch, Lake George, NY (US); Chris Sheedy, West Bridgewater, MA (US)

(73) Assignee: Cashman Dredging and Marine Contracting, Co., LLC, Quincy, MA (US)

( * ) Notice: Subject to any disclaimer, the term of this patent is extended or adjusted under 35 U.S.C. 154(b) by 0 days.

(21) Appl. No.: 16/361,352

(22) Filed: Mar. 22, 2019

(65) Prior Publication Data

US 2019/0292743 A1 Sep. 26, 2019

Related U.S. Application Data

(60) Provisional application No. 62/647,161, filed on Mar. 23, 2018.

(51) Int. Cl.

| | |
|---|---|
| ***E02D 7/06*** | (2006.01) |
| ***E02D 13/06*** | (2006.01) |
| ***E02D 5/24*** | (2006.01) |
| ***E02D 27/52*** | (2006.01) |
| ***E02D 33/00*** | (2006.01) |

(Continued)

(52) U.S. Cl.

CPC ..... *E02D 7/06* (2013.01); *E02D 5/24* (2013.01); *E02D 5/803* (2013.01); *E02D 13/06* (2013.01); *E02D 27/525* (2013.01); *E02D 33/00* (2013.01); *E02D 2250/0061* (2013.01); *E02F 3/38* (2013.01)

(58) Field of Classification Search

CPC ..... E02D 13/06; E02D 33/00; E02D 5/80; E21D 20/00

USPC ..... 405/228, 259.1

See application file for complete search history.

(56) References Cited

U.S. PATENT DOCUMENTS 3,855,745 A * 12/1974 Patterson ..... E02D 5/805 405/244

5,932,815 A 8/1999 Dodds 6,598,555 B1 7/2003 Bruce (Continued)

FOREIGN PATENT DOCUMENTS

JP 07043160 * 2/1995

JP 07043160 A 2/1995

(Continued)

*Primary Examiner* — Sean D Andrish

(74) *Attorney, Agent, or Firm* — Jacob M. Ward; Ward Law Office LLC

(57) ABSTRACT

An anchor driving device includes an anchor, a driving member with a slide stop, an anchor rod, a slide collar, and a load cell. The driving member is removably coupled to the anchor. The slide stop of the driving member is spaced apart from and disposed above the anchor. The anchor rod is permanently coupled to the anchor. The slide collar is disposed on the driving member and is selectively affixed to the driving member with a release mechanism. The load cell is permanently coupled to the slide collar and selectively coupled to the anchor rod. The load cell is configured to measure a load through the anchor rod during a setting operation of the anchor.

10 Claims, 3 Drawing Sheets

(51) Int. Cl.
*E02D 5/80* (2006.01)
*E02F 3/38* (2006.01)

(56) References Cited

U.S. PATENT DOCUMENTS

| | | | | |
|---|---|---|---|---|
| 7,823,654 | B2 * | 11/2010 | Kennett | E04H 17/263 173/112 |
| 2003/0084620 | A1 | 5/2003 | Benincasa et al. | |
| 2016/0025608 | A1 * | 1/2016 | Darlington | E21D 21/0093 73/12.06 |
| 2016/0122968 | A1 | 5/2016 | Jung | |

FOREIGN PATENT DOCUMENTS

| | | | |
|---|---|---|---|
| WO | 2013053936 | A1 | 4/2013 |
| WO | 2013140421 | A1 | 9/2013 |

* cited by examiner

ANCHOR DRIVING DEVICE

CROSS-REFERENCE TO RELATED APPLICATIONS

This application claims the benefit of U.S. Provisional Application No. 62/647,161, filed on Mar. 23, 2018, the entire disclosure of which is hereby incorporated herein by reference.

FIELD

The present disclosure relates to earth anchor driving and, more particularly, to a device and method for driving an anchor into the earth.

BACKGROUND

Earth anchoring systems are known for use in holding objects such as underwater concrete mattresses in place. Such anchoring systems are also used to secure buoys, floating docks and pipelines, and as anchor moorings to help protect reefs and natural resources, among many other applications.

Known technology for installing earth anchoring systems includes drilling a hole and/or jetting a hole into the soil, usually by divers or surface-based drill rigs when the anchoring takes place underwater, then inserting the earth anchor into the hole and backfilling with soil or concrete. Such technology is not environmentally sensitive and can be time-consuming and expensive to implement.

Surface-powered hydraulic and pneumatic vibratory hammering devices also exist for vertically driving such anchors into the soil. One known type of earth anchor that may be driven by such methods is the MANTA RAY MR-SR™ anchor, commercially available from Foresight Products in Fort Mill, S.C. Such anchors are driven into the ground with no holes, no digging and no concrete. This anchor compacts the soil around itself, providing a safe and environmentally sensitive installation. Once driven to the proper depth, an upward pull on the anchor tendon rotates the anchor into a perpendicular "anchor lock" position in undisturbed soil.

Anchors must also be driven to a minimum depth, typically at least 15 feet beneath the floor surface, during installation. Proper holding capacity must also be measured so that the anchors can be used with confidence. Ensuring proper placement and holding capacity for each anchor can be time-consuming, slow, and expensive.

There is a continuing need for an anchor driving device and method that ensures proper placement, setting, and holding capacity for an anchor.

SUMMARY

In concordance with the instant disclosure, an anchor driving device and method that ensures proper placement, setting, and holding capacity for an anchor is surprisingly discovered.

In one embodiment, an anchor driving device includes an anchor, a driving member with a slide stop, an anchor rod, a slide collar, and a load cell. The driving member is removably coupled to the anchor. The slide stop of the driving member is spaced apart from and disposed above the anchor. The anchor rod is permanently coupled to the anchor. The slide collar is disposed on the driving member and is selectively affixed to the driving member with a release mechanism. The load cell is permanently coupled to the slide collar and selectively coupled to the anchor rod. The load cell is configured to measure a load through the anchor rod during a setting operation of the anchor.

The anchor driving device may further include an excavator mounted on a barge disposed on water. The excavator may include a control room with a computer system that is interfaced to a boom. The anchor itself may also be selectively rotatable about the anchor rod from an inline or parallel insertion position into a locked perpendicular position for anchoring purposes.

A computer system may also be provided for controlling and monitoring the anchor driving device. The computer system may be disposed in a control room of the excavator. For example, the computer system may be interfaced with a boom of the excavator. The boom of the excavator may have at least three pivot connections, where the boom is pivotably connected to an excavator bucket that is connected on a top of an I-beam.

The computer system may be in electrical communication with the load cell that determines a holding capacity of the driven anchor by way of a digital cable (e.g., a wire, coaxial cable, Ethernet cable, etc.) or wireless connection. The load cell has mechanical attachment points respectively at top and bottom ends thereof. The top attachment point is connected to the driving member by way of a heavy upper chain that is welded thereto. The bottom attachment point is attached to a permanent anchor rod by way of a lower chain. Where used, the digital cable may be connected between the computer system and the load cell. The computer system may further have a resident guidance system with global positioning system capabilities to facilitate a placement of the anchor.

The driving member and the anchor rod may be disposed adjacent to and substantially parallel with one another and the driving member may be welded to a bottom of the I-beam. The upper chain may be welded to the slide collar. The slide stop may be spaced apart from the slide collar and disposed between the slide collar and the anchor. The slide stop may be configured to militate against the slide collar from sliding all the way down to an end of the driving member when decoupled from the driving member. The load cell may also be threadedly connected to the slide collar and the load cell wire extended from the load cell to above the water level. The lower load cell chain is connected to the load cell via a lifting eye that has an anchor rod shackle attached to a permanent eye, which in turn is attached to the anchor rod, thereby connecting the load cell to the anchor rod.

In another embodiment, an anchor driving device includes an anchor, a driving member removably coupled to the anchor, a computer system, an anchor loading stand, a global position system, an anchor rod, a slide collar, a release mechanism, and a load cell. The driving member has a slide stop spaced apart from and disposed above the anchor. The computer system has a display directed to proper alignment and location of the driving member. The anchor loading stand is located on an earth floor. The anchor loading stand has an anchor drive hole formed therethrough. The global positioning system is utilized to line up the anchor over the anchor loading stand and through the anchor drive hole. The anchor rod is permanently coupled to the anchor. The slide collar is disposed on the driving member. The slide collar is selectively affixed to the driving member with a release mechanism. The release mechanism is actuated, either manually or automatically, in order to free the slide collar into a rest position on the slide stop, thereby permitting the driving member to be selectively engageable and releasable with the anchor rod. The load cell is permanently coupled to the slide collar and selectively coupled to the anchor rod. The load cell is configured to measure a load through the anchor rod during a setting operation of the anchor.

In yet another embodiment, the anchor driving device includes the driving member as a driving steel with the anchor disposed on a barge at a water line. The device further includes a computer system and a global positioning system. The computer system has a display directed to proper alignment and location of the driving member. The global positioning system is utilized to line up the anchor over an anchor loading stand located on an earth floor. A bucket of an excavator may be connected between the boom and an I-beam, the I-beam attached to the driving member. The release mechanism is utilized to free the slide collar into a rest position on the fixed slide stop. The driving member is engageable and releasable with the anchor rod. Load readings are determinable of a maximum predetermined load and a distance below the earth floor of the anchor, and a distance dropped and movement of the anchor from a vertical to a horizontal position, within the earth floor. A lifting eye is releasable from the anchor rod when a load is relaxed on a shackle of the lifting eye. The driving member is raiseable up and out of the sediment of the earth floor. An object is connectable to a permanent eye on the anchor rod disposed above the earth floor where the anchor is in a secure place below the earth floor. The driving member is locatable in a loading stand located on a platform deck of the excavator.

In a further embodiment, a method of setting an anchor into an earth floor includes provision of the anchor drive device as described herein. The method further includes steps of lowering the driving member with the anchor to the earth floor and applying a dynamic force to the anchor through the driving member. The anchor is thereby lowered to a required elevation or depth below the earth floor. The release mechanism is then used to free the slide collar to rest on the slide stop of the driving member. This permits for a raising of the driving member to engage the anchor rod, by an abutting of the slide collar with the slide stop, thereby causing the anchor to be set. The load readings on the anchor are then monitored to determine whether a maximum predetermined load exists on the anchor, which likewise indicates that the anchor has moved from an insertion position (e.g., vertical orientation) to a set position (e.g., horizontal orientation) within the earth floor. The anchor rod is then disconnected from the driving member, and the driving member is raised up and out of the earth floor to that additional anchors may be driven and set into the earth floor.

In yet a further embodiment, a method of driving an anchor into the earth includes a step of lowering a driving member with an anchor, from a barge to below a water line, with a boom. An anchor location is displayed on a computer system. The method further includes a step of communicating, between an operator and a diver, proper alignment and a driving member location free of obstructions. A global positioning system may be employed to line up the anchor over an anchor loading stand located on an earth floor. A dynamic force from a bucket, connected between the boom and an I-beam attached to the driving member, is then applied to the anchor, thereby lowering the anchor to a required elevation below the earth floor. A release mechanism is then moved to free the slide collar to rest on a fixed slide stop. The driving member is then raised to engage an anchor rod, thereby causing the anchor rod to be released from the driving member. The load readings on the anchor are then monitored to determine if a maximum predetermined load exists on the anchor, in coordination with the distance traveled below the earth floor, to determine that the anchor has dropped and gone from a vertical to a horizontal position, within the earth floor. A lifting eye is then released from the anchor rod by relaxing the load on a shackle of the lifting eye, and the driving member is raised up and out of the sediment of earth floor. An object is then connected to a permanent eye on the anchor rod above the earth floor. The anchor remains securely in place below the earth floor that is to be connected to a desired object to be anchored. The driving member is then returned to a loading stand located on a platform deck of the excavator.

The method may further include a step of interfacing the boom to the excavator by way of a computer located in a control room. The boom of the excavator has at least three pivot connections and is pivotably connected to an excavator bucket. A top of the I-beam may further be connected to the excavator bucket. The load cell capacity may be determined with the computer system. The anchor is rotatable about the anchor rod, thereby allowing the anchor to be placed into a locked perpendicular position. The method may further include a step of utilizing a load locker disposed on a graded shoreline embankment earth floor with the anchor rod being screwed into the anchor.

The computer system electrically communicates with the load cell determining the holding capacity of the driven anchor by way of the digital cable. For example, the load cell comprises mechanical attachment points respectively at top and bottom ends thereof. The top load cell attachment point is attached to the driving member by welding a heavy upper chain thereto. A bottom load cell attachment point is attached to a permanent anchor rod by way of a lower chain.

DRAWINGS

The above, as well as other advantages of the present disclosure, will become readily apparent to those skilled in the art from the following detailed description, particularly when considered in the light of the drawings described hereafter.

Figure 1:
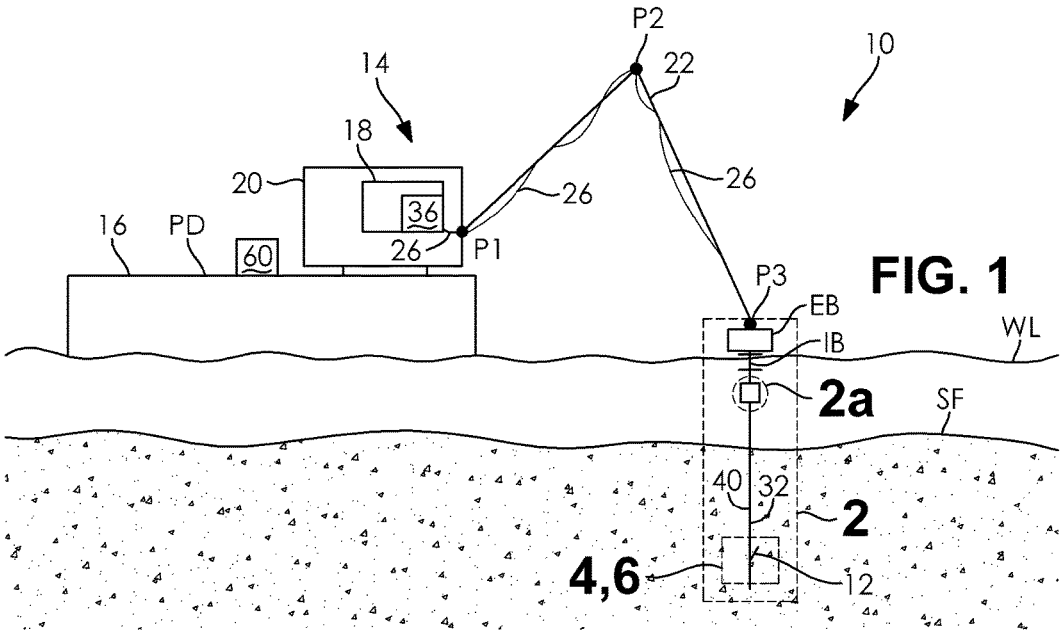
FIG. 1 is a schematic representation of an anchor driving system in accordance with one embodiment of the present disclosure.
Figure 2:
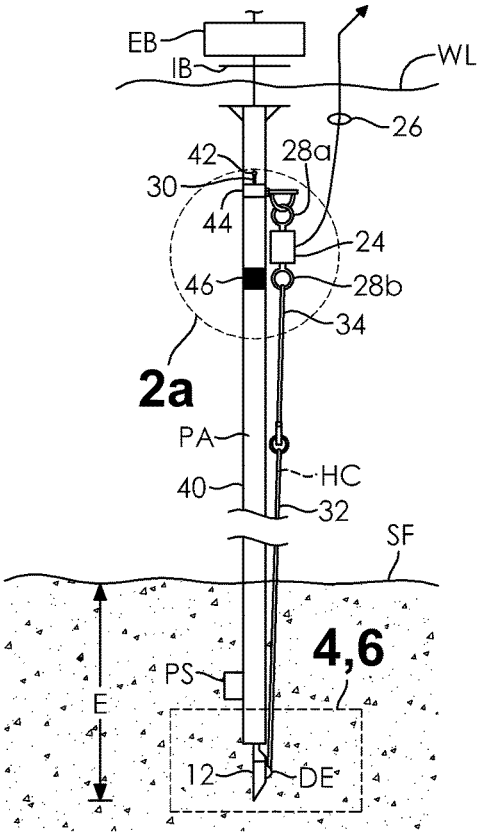
FIG. 2 is an enlarged partial schematic representation taken at call-out 2 of the anchor driving system shown in FIG. 1.
Figure 2A:
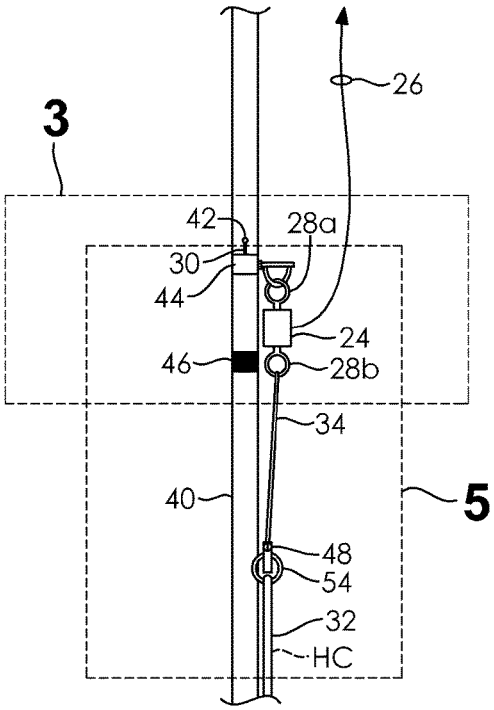
Figure 3:
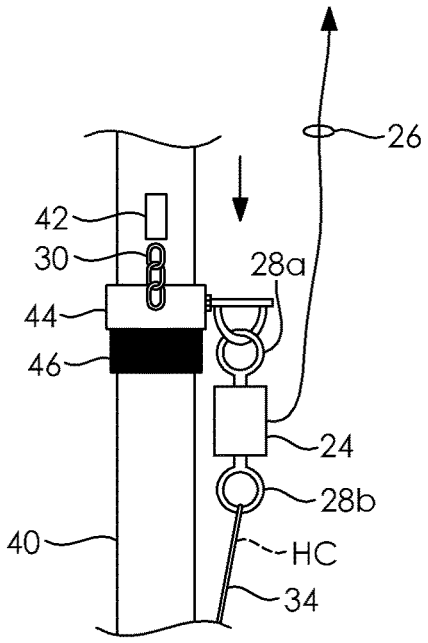

FIG. 2*a* is an enlarged partial schematic representation taken at call-out 2*a* of the anchor driving system shown in FIGS. 1 and 2;

FIG. 3 is an enlarged partial schematic representation taken at call-out 3 of the anchor driving system shown in FIG. 2*a;*

Figure 4:
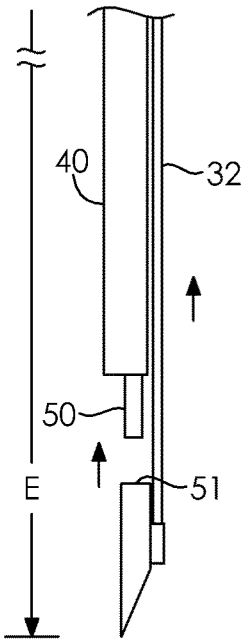
Figure 5:
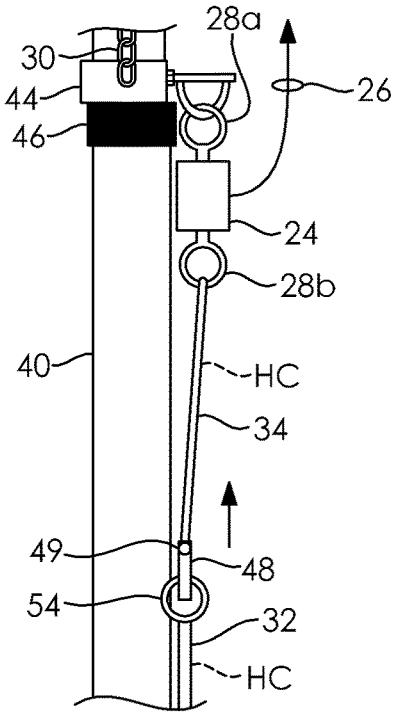

FIG. 4 is an enlarged partial schematic representation taken at call-out 4, 6 of the anchor driving system shown in FIGS. 1 and 2, and showing the anchor in an insertion position;

FIG. 5 is an enlarged partial schematic representation taken at call-out 5 of the anchor driving system shown in FIG. 2*a;*

Figure 6:
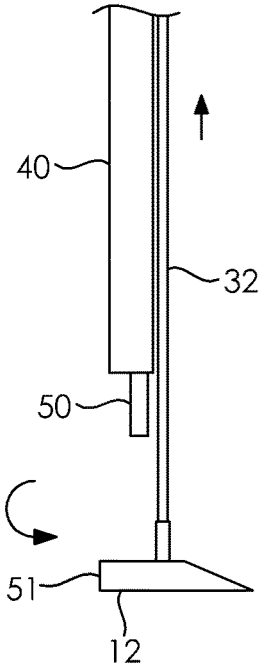
Figure 7:
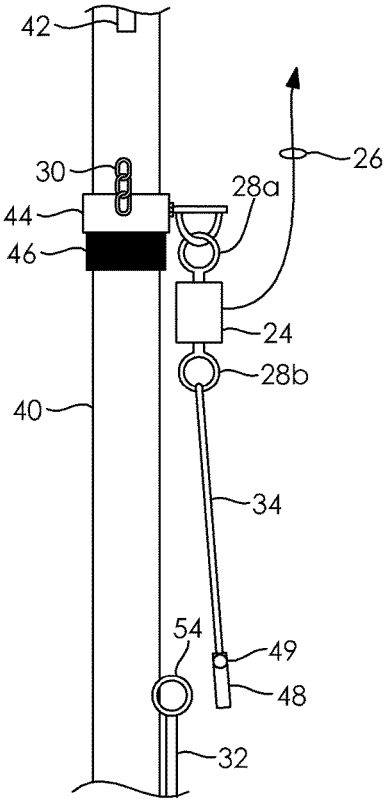
Figure 8:
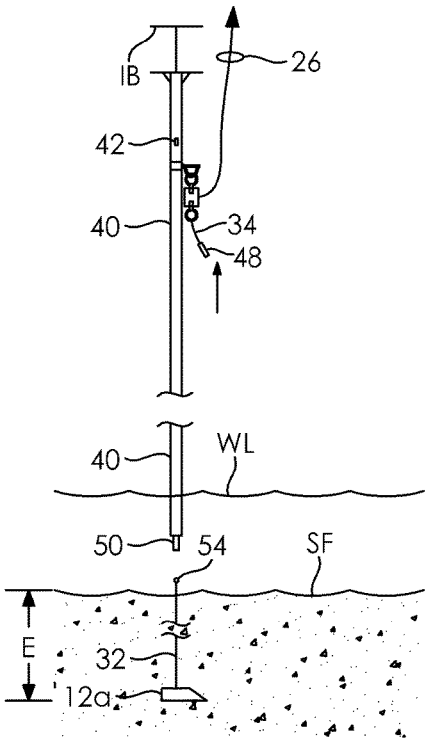
Figure 9:
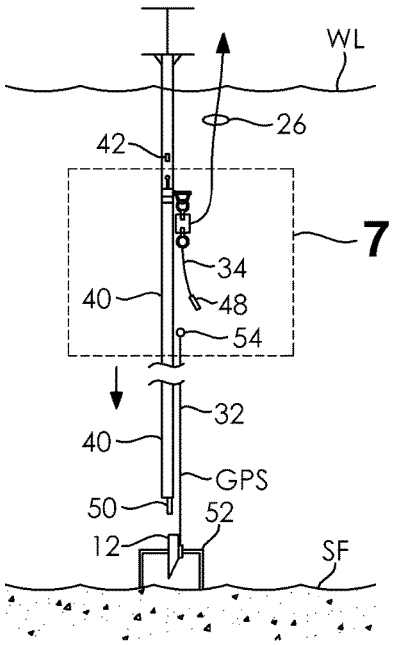
Figure 10:
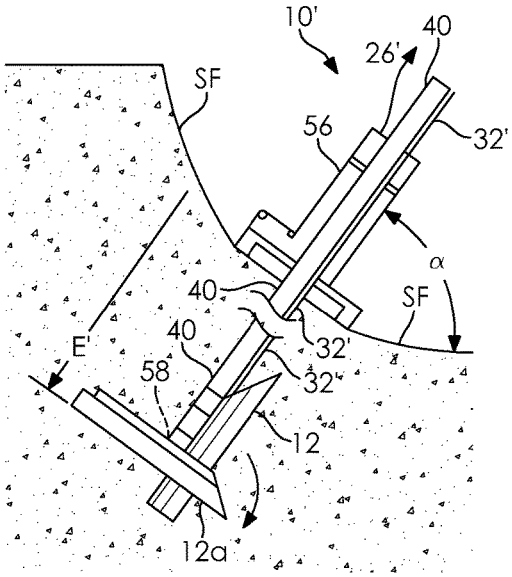

FIG. 6 is an enlarged partial schematic representation taken at call-out 4, 6 of the anchor driving system of FIGS. 1 and 2, and showing the anchor in a set position;

FIG. 7 is an enlarged partial schematic representation taken at call-out 7 of the anchor driving system shown in FIG. 9;

FIG. 8 is a second schematic representation of the anchor driving system in accordance with the present disclosure;

FIG. 9 is a third schematic representation of the anchor driving system in accordance with the present disclosure; and FIG. 10 is a schematic representation of a load locker in accordance with the present disclosure.

DETAILED DESCRIPTION

The following description is merely exemplary in nature and is not intended to limit the present disclosure, application, or uses. In respect of the methods disclosed, the order of the steps presented is exemplary in nature, and thus, is not necessary or critical unless otherwise disclosed.

In an exemplary embodiment, there is shown in FIGS. 1-10 an anchor driving device 10 for driving and setting an anchor 12, such as a MANTA RAY MR-SR™ anchor as a non-limiting example. The anchor driving device 10 may utilize an excavator 14, like that provided by SENNEBOGEN® excavators as a non-limiting example. The excavator 14 is typically mounted on a barge 16 floating at water level (WL). One of ordinary skill in the art may also select other suitable types of earth anchors and excavator equipment for installing the same within the scope of the present disclosure.

Remote control of a setting operation for the anchor 12 is achieved by use of a computer system 18. In certain examples, the computer system 18 may be disposed in a control room 20 of the excavator 14. For example, the computer system 18 is interfaced with actuators of a boom 22 of the excavator 14. The actuators may be hydraulic, electric, or pneumatic, and in most particular embodiments are hydraulic cylinders. The boom 22 may have at least three pivot connections (P1-P3). The boom 22 is utilized to mechanically raise, lower, place, and set the anchor 12 in accordance with the method described herein. A skilled artisan may also select other suitable types and configurations of the boom 22, as desired.

The computer system 18 is in electrical communications with a submersible load cell 24. The load cell 24 is configured to determine a holding capacity, load, or force (HC) caused by a driving and setting of the anchor 12, for example, by way of a digital cable 26 connected between the computer system 18 and the load cell 24. Other means for communication between the load cell 24 and the computer system 18, including wireless means, may also be employed.

The load cell 24 has mechanical attachment points 28*a*, 28*b* respectively at top and bottom ends thereof. A top attachment point 28*a* may be connected to the excavator 14 through a slide collar 44 disposed on a tubular driving member 40, where the slide collar 44 is either connected to the tubular driving member 40 with a heavy upper chain 30 or the slide collar 44 is abutting a slide stop 46 of the tubular driving member 40, for example. A bottom attachment point 28*b* may be attached to a permanent anchor rod 32 by way of a lower chain 34, also as an example.

Where the digital cable 26 is connected between the computer system 18 and the load cell 24, a computer operator (not shown) can monitor and record results like the holding capacity, load, or force (HC), by way of a screen 36 of the computer system 18, for example, as shown in FIG. 1.

The digital cable 26 and the screen 36 are in communication with the computer system 18, which may have one or more processors that may have one or more sets of physical memory. The memory includes tangible and non-transitory processor-readable media. The computer system 18 may further have a resident guidance system with global positioning system (GPS) capabilities. The memory may contain at least one database on which load cell data is stored, for example. The processor is configured to execute computer-readable instructions on its memory, including instructions for operation of the anchor driving device 10 in accordance with the methods described herein.

The operator may utilize the guidance system to determine an elevation or depth (E) of the anchor 12 below the earth floor (SF). As used herein, the term "earth floor" encompasses the floors of all types of bodies of water, including floors or beds of rivers, lakes, bays, seas, and oceans, as particular non-limiting examples. In a most particular embodiment, the term "earth floor" indicates a sea floor of a body of water.

Through execution of the computer-readable instructions, the computer is configured to receive the load cell data (HC) and to generate images on the screen 36. In turn, data and images permit the operator to conveniently review and understand the load cell data being provided. The operator of the computer system 18 is free to select suitable computer technology to realize the benefits of the anchor driving device 10. This selectivity may include wireless transceivers (not shown) instead of a use of the digital cable 26 to communicate with the load cell 24, while remaining within the scope of the present disclosure.

After the anchor 12 is mechanically driven down to the required elevation (E) below the earth floor (SF, see a down arrow in FIG. 3), the excavator 14 will pull upwardly (see up arrows in FIGS. 4 and 5) on the permanent anchor rod 32 to set the anchor 12. The load cell 24, which is connected between the excavator 14 and the permanent anchor rod 32, measures the holding capacity, load, or force (HC), along with confirmation that the permanent anchor rod 32 has reached the maximum required amount or threshold of force (HCmax) indicative of the anchor 12 having been moved from an insertion position to a set position that militates against a pulling of the anchor 12 from the earth floor. As a result, the anchor 12 is determined to be properly set.

An excavator guidance system within the computer system 18 then displays the elevation (E) of the anchor 12 attached to the permanent anchor rod 32, and which is below the earth floor (SF). The load cell holding capacity, load, or force (HC) may also be displayed in real-time to the operator. As illustrated by the anchor 12 in FIG. 6, the anchor 12 is rotated from the insertion position, which is generally perpendicular to the earth floor (SF), and into place to the set position, which is generally parallel to the earth floor (SF), merely by pulling upwardly on the permanent anchor rod 32. Where the anchor 12 is in the set position, the force on the load cell 24 increases significantly as the permanent anchor rod 32 is being pulled upon. Consequently, the operator can monitor both the elevation (E) and use holding capacity, load, or force (HC) on the anchor 12 to ascertain that the anchor 12 has been set. The anchor 12 will be raised until a predetermined target or threshold of the holding capacity, load, or force (HCmax) is met, before subsequently releasing the anchor 12 from the tubular driving member 40.

In operation, and prior to the start of installation of multiple ones of the anchor 12, an anchor 12 may be provided as a test anchor and be driven and set, in order to establish the target test or threshold force (HCmax) to be applied to remaining anchors 12, and thereby confirm that the anchor 12 is set properly. Other suitable means for establishing the target test or threshold force (HCmax) may also be selected by a skilled artisan, as desired.

A suitable type of anchor driving device 10 according to various embodiments of the disclosure is shown in FIG. 2.

The anchor driving device 10 may have a MANTA RAY MR-SR™ anchor disposed at one end, as one non-limiting example. However, it should be understood that other types of anchors may also be used within the scope of the present disclosure.

With reference to FIG. 2, the anchor driving device 10 of the present disclosure has the tubular driving member 40 and the anchor rod 32 (also known as the "permanent rod"), which are disposed adjacent to and substantially parallel with one another. The driving member 40 may be a "driving steel," for example. Although the term "driving steel" is employed herein, and generally connotes a suitable material used for the drive component of the anchor driving device 10, it should be understood that the driving member 40 is not necessarily formed from steel and may be made from other suitable materials as desired.

The anchor driving device 10 may also include an I-beam (IB). The I-beam (B) may be disposed on an end of the tubular driving member 40 opposite the anchor 12. Advantageously, the I-beam (IB) may be use for the excavator bucket (EB) to pick up the driving member 40. The driving member 40 may be welded to the I-beam (IB), for example. One skilled in the art may also select other suitable means for moving the driving member 40 by the excavator or other equipment, as desired.

As shown in FIGS. 2-3, 5, and 7, there is a slide collar 44 that is slidably disposed on the driving member 40. The upper chain 30 may be welded to the slide collar 44. The upper chain 30 further has a release mechanism 42, which may be pulled manually via rope (not shown) by a diver (not shown) to selectively decouple the slide collar 44 from the driving member 40. In other examples, the release mechanism 42 may include an actuator remotely activated via the computer system. Other suitable means for decoupling the upper chain 30 of the slide collar 44 from the driving member 40 may also be employed within the scope of the disclosure.

The slide stop 46 is affixed to the driving member 40, for example, by welding to the driving member 40. Where the anchor 12 is in the process of being driven into the earth, the slide stop 46 may be spaced apart from the slide collar 44 and disposed between the slide collar 44 and the anchor 12. The upper chain 30 suspends the slide collar 44 above the slide stop 46 in this case. Where the upper chain 30 has been decoupled from the driving member 40, the slide stop 46 is configured to militate against the slide collar 44 sliding all the way down to an end of the driving member 40.

The load cell 24 (for example, a LCC-HRS™ hermetically sealed bi-directional load cell commercially available from Load Cell Central in Milan, Pa., USA) may be threadedly connected to an eyelet functioning as a top attachment point 28*a*, which in turn is connected to the slide collar 44, for example, as shown in FIG. 3. A load cell signal wire or the digital cable 26 extends from the load cell 24 to above the water level (WL, shown in FIG. 1). The lower load cell chain 34 connects the load cell 24 to a lifting eye 48 with an anchor rod shackle 49. The anchor rod shackle 49 is in turn is attached to a permanent eye 54, as shown in FIG. 2*a*. The permanent eye 54 is attached to the anchor rod 32. Through this portion of the process, where the lower attachment point 28*b* is attached via the lower load cell chain 34 to the permanent eye 54 of the anchor rod 32, the load cell 24 is connected to the anchor rod 32.

FIGS. 2-9 depict a method of using the anchor driving device 10, according to various embodiments of the disclosure. It should be appreciated that this method of the present disclosure is not necessarily limited to just these steps, and that a skilled artisan may also employ other steps associated with driving the anchor 12 into the earth, and setting the anchor 12 within the earth, either above water or below water, within the scope of the present disclosure.

As shown in FIG. 9, a first step involves an operator, typically in the control room 20, lowering the driving member 40 with the permanent anchor assembly 12 of the anchor driving device 10 from the barge 16 to below the water line (WL). The computer system 18, in the control room 20, displays an anchor location. For example, the operator may then line up the driving member 40 over a desired location on the earth floor (SF). The desired location may also have an anchor loading stand 52 preinstalled at the location. In certain examples, the operator may use GPS to line up the location of the drive position for the anchor 12. A diver may then verify manually that the operator has achieved proper alignment. The diver will also confirm that the drive location is free of any obstructions. The diver may further inform the operator of any minor adjustments that need to be made, at this time.

With reference to FIG. 2, the operator may then cause the driving member 40 and anchor assembly 12 to be moved to the required elevation (E) in a second step. Pitch sensors (PS) attached to the driving member 40 and linked to the screen 36 on the computer system 18 in the control room 20, for example, allow the operator to maintain alignment during this driving operation. In addition, the excavator 14 may be outfitted with GPS that provides information on the elevation or depth (E) of the driving member 40 in near real-time throughout the driving operation.

In particular, the operator will achieve a desired embedment of the anchor using a GPS guidance system that is contained within the computer system 18. Based on the borings and the action of the spuds during dredging (i.e., they can settle under their own weight as much as 15 feet), it has been determined that this approach may be successfully used to position the anchor 12. Optional external vibrators (not shown) may also be mounted to the excavator bucket (EB, shown in FIGS. 1-2) to add a dynamic force to facilitate the insertion and driving operation of the anchor 12, as desired.

A third step may involve the operator confirming that the anchor assembly 12 is at the required depth or elevation (E). Once confirmed, and as shown in FIGS. 3, 4, and 7, the diver or some other personnel above the water level WL may manually decouple the slide collar 44 from the driving member 40 so that it is free to rest on the fixed slide stop 46. The operator then slowly raises the driving member 40 (as see by an up arrow in FIG. 6), which engages the permanent anchor rod 32 via an abutting of the slide collar 44 with the fixed slide stop 46.

In turn, and via the slow raising of the anchor rod 32 by the driving member 40, the anchor 12 is "tripped" from vertical (the insertion position) to horizontal (the set position) as it is raised, which is illustrated by a counterclockwise arrow in FIG. 6. The down arrow in FIG. 3 shows that the slide collar 44 has moved down to the collar stop 46 upon being manually released and the driving member 40 pulled upwardly.

With reference to the up arrow in FIG. 8, a fourth step includes the operator raising the driving member 40. The up arrow in FIG. 4 also shows that, because of a pulling upon the I-beam (IB) by the excavator or surface equipment, the driving member nipple 50 is pulled out of a respective mating portion 51 of the anchor 12 following the driving operation. In this fourth step, the operator monitors the load readings (HC) on the anchor 12 via the screen 36 on the computer system 18. These readings are supplied from the load cell 24 that is connected between the driving member 40 and the permanent anchor rod 32. When the readings (HC) indicate that a maximum or threshold predetermined load (HCmax) has been reached, in coordination with earlier determining the distance (E) traveled below the earth floor (SF) to which the anchor 12 has inserted, then the operator is assured that the head of the anchor 12 has "tripped" through rotation (for example, see counter clockwise arrow in FIG. 6). Consequently, the operator ceases raising the anchor driving device assembly 10.

FIG. 5 illustrates the anchor rod 32 with the permanent eye 54 being connected to the lower eye 28*b* of the load cell 24. This connection allows the load cell 24 to detect the load (HC) that results from the operator pulling up on the I-beam (IB) as the load (HC) is transferred through the anchor rod 32 and onto the load cell 24. FIG. 6 illustrates that the anchor 12 has "tripped" due to the pulling up (see up arrow) on the I-beam (IB), wherein the load (HC) has been transferred through the anchor rod 32 and onto the load cell 24.

As shown in FIGS. 7-8, a fifth step involves notifying the diver so that the diver may release the lifting eye 48 with a shackle 49 connecting the driving member 40 to the permanent anchor rod 32. During this step, the operator may relax the load (HC) on the anchor rod 32 by not pulling upwardly on the driving member 40, so that the shackle 49 of the lifting eye 48 is not stressed and may be easily undone or decoupled by the diver. Other suitable means for releasing the lifting eye 48 with the shackle 49 including automated actuator means via the computer system may also be employed, as desired.

A sixth step is shown in FIGS. 8-9. Once the diver has removed the shackle 49 and has moved to a safe area, the operator slowly raises the driving member 40 up and out of the sediment of earth floor (SF), and to an anchor loading stand 60 located on the platform deck (PD, shown in FIG. 1) of the excavator 14. The original permanent steel anchor 12 remains in place below the earth floor SF and is connected to a desired object to be anchored (e.g., a concrete mattress), as required.

Subsequently, the anchor loading stand 60 shown in FIG. 1 is used to stabilize a new anchor assembly 12, while lining up the original driving device 40. While in the stand 52, a new permanent anchor rod 32 and anchor head unit 12 are connected to the driving member 40 for a next location of installation on the earth floor (SF). For example, using a scissor lift (not shown), the new anchor rod 32 may be connected to the load cell shackle 49 and the slide collar 44 is returned to its driving position with the upper chain 30 coupled with the release mechanism 42 to the driving member 40. In the meantime, an anchor driver stand (not shown), which may also be welded to the platform deck (PD), is used to store the driving member 40 when it is not in use.

The above described anchor driving device 10 and method, which are utilized with the earth floor (SF) that is substantially parallel to the water level (WL), may be modified to be utilized with a shoreline embankment as shown in FIG. 10. In FIG. 10, like or related structure to that shown in FIGS. 1-9 is identified with a same reference number and a prime symbol (') for purpose of clarity.

For such a shoreline embankment application, the earth floor (SF) typically has a grade that is not substantially parallel to the water level (WL). As depicted in FIG. 10, the anchor 12, driving member device 40, and an alternate permanent anchor rod 32' are disposed through a load locker 56. The load locker 56 is disposed on the graded shoreline embankment earth floor (SF). For such an embodiment, the permanent anchor rod 32 might also be tied to a concrete mattress (not shown) for prevention of shoreline erosion.

With such an alternate shoreline embankment orientation anchor driving device 10', the driving member 40 would be operated substantially as described hereinabove. However, an alternate permanent anchor rod 32' may be screwed into the anchor 12 and driven into the shoreline earth floor (SF) at an angle $\alpha$ to a proper elevation or depth (E'). Then, the driving member 40 would be removed by rotating the anchor 12 out of a threaded anchor hole 58. In addition, the load locker 56, as shown in FIG. 10 would be utilized to prove that the anchor 12 was load locked into anchor 12*a* position. Load locking this position of the anchor 12*a* is indicated by the clockwise arrow in FIG. 10. To assure proper load locking, the load locker 56 may communicate the load (HC) to the computer system 18 by way of digital cable 26'.

Advantageously, the anchor driving devices 10, 10' and associated methods described hereinabove and shown in the appended drawings ensures proper placement, setting, and holding capacities (HC) for the anchor 12.

While certain representative embodiments and details have been shown for purposes of illustrating the invention, it will be apparent to those skilled in the art that various changes may be made without departing from the scope of the disclosure, which is further described in the following appended claims.

What is claimed is:

1. An anchor driving device, comprising:

an anchor;

a driving member removably coupled to the anchor, the driving member having a slide stop spaced apart from and disposed above the anchor;

an anchor rod permanently coupled to the anchor;

a slide collar disposed on the driving member, the slide collar selectively affixed to the driving member with a release mechanism;

a load cell permanently coupled to the slide collar and selectively coupled to the anchor rod; and an excavator mounted on a barge disposed on water, wherein the excavator comprises a control room with a computer system that is interfaced to a boom and the anchor is rotatable about the anchor rod from an inline or perpendicular position for setting into a locked perpendicular position for anchoring, wherein the load cell is configured to measure a load through the anchor rod during a setting operation of the anchor, and wherein the boom of the excavator has at least three pivot connections, and wherein the boom is pivotably connected to an excavator bucket that is connected on a top of an I-beam.

2. The anchor driving device of claim 1, wherein the computer system is in electrical communication with the load cell that determines a holding capacity of the driven anchor by way of a digital cable, and the load cell has a top attachment point at a top end thereof, and a bottom attachment point at a bottom end thereof.

3. The anchor driving device of claim 2, wherein the top attachment point is connected to the driving member by way of a heavy upper chain that is welded to the slide collar, and the bottom attachment point is attached to the permanent anchor rod by way of a lower chain, and the digital cable is connected between the computer system and the load cell.

4. The anchor driving device of claim 3, wherein the computer system further has a resident guidance system with global positioning system capability.

5. The anchor driving device of claim 4, wherein the driving member and the anchor rod are disposed adjacent to and substantially parallel with one another and the driving member is welded to a bottom of the I-beam.

6. A method of setting an anchor into an earth floor, the method comprising the steps of:

providing an anchor driving device, including the anchor, a driving member, an anchor rod, a slide collar, and a load cell, the driving member removably coupled to the anchor, the driving member having a slide stop spaced apart from and disposed above the anchor, the anchor rod permanently coupled to the anchor, the slide collar disposed on the driving member, the slide collar selectively affixed to the driving member with a release mechanism, and the load cell permanently coupled to the slide collar and selectively coupled to the anchor rod, wherein the load cell is configured to measure a load through the anchor rod, wherein the boom of the excavator has at least three pivot connections and is pivotably connected to an excavator bucket;

interfacing the boom to the excavator by way of a computer located in a control room;

connecting a top of an I-beam to the excavator bucket;

lowering the driving member with the anchor to the earth floor;

applying a dynamic force to the anchor through the driving member, thereby lowering the anchor to a required elevation below the earth floor;

actuating the release mechanism to free the slide collar to rest on the slide stop of the driving member;

raising the driving member to engage the anchor rod, thereby causing the anchor to be set;

monitoring the load readings on the anchor and determining a holding capacity of the anchor with the computer system via the load cell to determine if a maximum predetermined load exists on the anchor to ascertain that the anchor has moved from an insertion position to a set position within the earth floor;

disconnecting the anchor rod from the driving member; and raising the driving member up and out of the earth floor.

7. The method of claim 6, wherein the anchor is rotatable about an end of the anchor rod, thereby allowing the anchor to be placed into the set position.

8. The method of claim 7, wherein the earth floor includes a graded shoreline embankment, and further comprising a step of utilizing a load locker disposed on the graded shoreline embankment.

9. The method of claim 8, further comprising the step of the computer system electrically communicating with the load cell to determine the holding capacity of the driven anchor by way of a digital cable.

10. The method of claim 9, wherein the load cell has a top load cell attachment point and a bottom load cell attachment point.

* * * * *